US010950186B2

(12) United States Patent
Hsieh

(10) Patent No.: US 10,950,186 B2
(45) Date of Patent: Mar. 16, 2021

(54) DISPLAY APPARATUS AND METHOD THEREOF

(71) Applicant: Novatek Microelectronics Corp., Hsinchu (TW)

(72) Inventor: Cheng-Tsu Hsieh, Taoyuan (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/522,660

(22) Filed: Jul. 26, 2019

(65) Prior Publication Data

US 2021/0027721 A1 Jan. 28, 2021

(51) Int. Cl.
*G09G 5/00* (2006.01)
*G09G 3/34* (2006.01)

(52) U.S. Cl.
CPC ..... *G09G 3/34* (2013.01); *G09G 2310/0251* (2013.01); *G09G 2310/0264* (2013.01)

(58) Field of Classification Search
USPC ..... 345/76, 92, 96, 156, 173, 174, 204, 209, 345/212, 690, 211, 87, 205; 365/185.03, 365/185.11, 189.16
See application file for complete search history.

(56) References Cited

U.S. PATENT DOCUMENTS

2007/0080905 A1* 4/2007 Takahara ..... G09G 3/3258 345/76
2011/0156995 A1* 6/2011 Choi ..... H01L 27/1288 345/92
2012/0162163 A1* 6/2012 Takatori ..... G11C 7/1051 345/205
2013/0127806 A1* 5/2013 Wu ..... G09G 3/3688 345/211
2013/0279251 A1* 10/2013 Lee ..... G11C 16/0483 365/185.03
2013/0343137 A1* 12/2013 Gupta ..... G11C 8/18 365/189.16
2014/0043223 A1* 2/2014 English ..... G09G 3/3473 345/156
2014/0104947 A1* 4/2014 Yamauchi ..... G11C 16/0483 365/185.09
2014/0347928 A1* 11/2014 Lee ..... G11C 16/0483 365/185.11
2015/0009202 A1* 1/2015 Cho ..... G09G 3/20 345/212

(Continued)

*Primary Examiner* — Thuy N Pardo
(74) *Attorney, Agent, or Firm* — JCIPRNET

(57) ABSTRACT

A display apparatus includes at least one source driver and a display panel having a display area and a non-display area, in which the display area includes a first array of transistors and the non-display area includes a second array of transistors. The at least one source driver is coupled to a first side of the display area and is configured to drive the first array of transistors. The second array of transistors are coupled to a second side of the display area of the display panel and is configured to perform a first pre-charge operation on a plurality of odd-number channels of the display panel and perform a second pre-charge operation on a plurality of even-numbered channels of the display panel through the second side of the display area. The first side of the display area is opposite to the second side of the display area.

22 Claims, 7 Drawing Sheets

(56) References Cited

U.S. PATENT DOCUMENTS

| | | | | |
|---|---|---|---|---|
| 2015/0078086 | A1* | 3/2015 | Lee | G11C 16/08 345/87 |
| 2015/0084946 | A1* | 3/2015 | Shim | G09G 3/3258 345/212 |
| 2015/0192772 | A1* | 7/2015 | Lewis | G09G 3/3466 345/690 |
| 2015/0255027 | A1* | 9/2015 | Wu | G09G 3/3614 345/96 |
| 2015/0340003 | A1* | 11/2015 | Choi | G09G 3/3688 345/92 |
| 2016/0104443 | A1* | 4/2016 | Lee | G09G 3/3677 345/209 |
| 2016/0163278 | A1* | 6/2016 | Pappas | G09G 3/006 345/212 |
| 2017/0011697 | A1* | 1/2017 | Takatori | G11C 7/1012 345/204 |
| 2018/0374877 | A1* | 12/2018 | Gao | H01L 27/1233 345/204 |
| 2019/0147784 | A1* | 5/2019 | Chiang | G09G 3/3614 345/173 |
| 2020/0025820 | A1* | 1/2020 | Zhao | G09G 3/3225 345/204 |
| 2020/0152141 | A1* | 5/2020 | Zhu | G02F 1/13 345/204 |

* cited by examiner

DISPLAY APPARATUS AND METHOD THEREOF

BACKGROUND

Technical Field

The disclosure generally relates to display apparatus, and more particularly relates to a display apparatus and a method thereof that is capable of improving performance of a pre-charge operation and a charge-sharing operation.

Description of Related Art

Nowadays, a display panel is one of the most common components in a large number of electronic devices such as televisions, computers, cell phones, wearable devices and the like. Existing display panels and especially display panels with high resolution and large-size encounter quality degradation caused by resistive-capacitive (RC) effects and insufficient pixel charging for pixels that are located in a relatively far away from a source driver.

As a demand for display panels with high resolution and large-in-size has grown recently, there has grown a need for more creative design for improving performance of the display panel, and especially for large-size display panels.

Nothing herein should be construed as an admission of knowledge in the prior art of any portion of the present disclosure.

SUMMARY

A display apparatus and a method thereof that are capable of improving performance of a pre-charge operation and a charge-sharing operation are introduced herein.

In some embodiments, the display apparatus includes a display panel and at least one source driver. The display panel includes a display area and a non-display area, in which the display area includes a first array of transistors and the non-display area includes a second array of transistors. The display panel has a plurality of channels divided into a plurality of odd-numbered channels and a plurality of even-numbered channels. The at least one source driver is coupled to a first side of the display area of the display panel and configured to drive the first array of transistors. The second array of transistors is coupled to a second side of the display area of the display panel and is configured to perform a first pre-charge operation on the odd-number channels and perform a second pre-charge operation on the even-numbered channels through the second side of the display area. The first side is opposite to the second side.

In some embodiments, the method includes steps of during a first pre-charge period, performing a first pre-charge operation on odd-numbered channels through the second side of the display panel and performing a second pre-charge operation on even-numbered channels through the second side of the display panel; and during a second pre-charge period, performing a third pre-charge operation on the odd-numbered channels through the first side of the display panel and performing a fourth pre-charge operation on the even-numbered channels through the first side of the display panel. The first pre-charge period overlaps the second pre-charge period.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

It is to be understood that other embodiments may be utilized and structural changes may be made without departing from the scope of the present disclosure. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
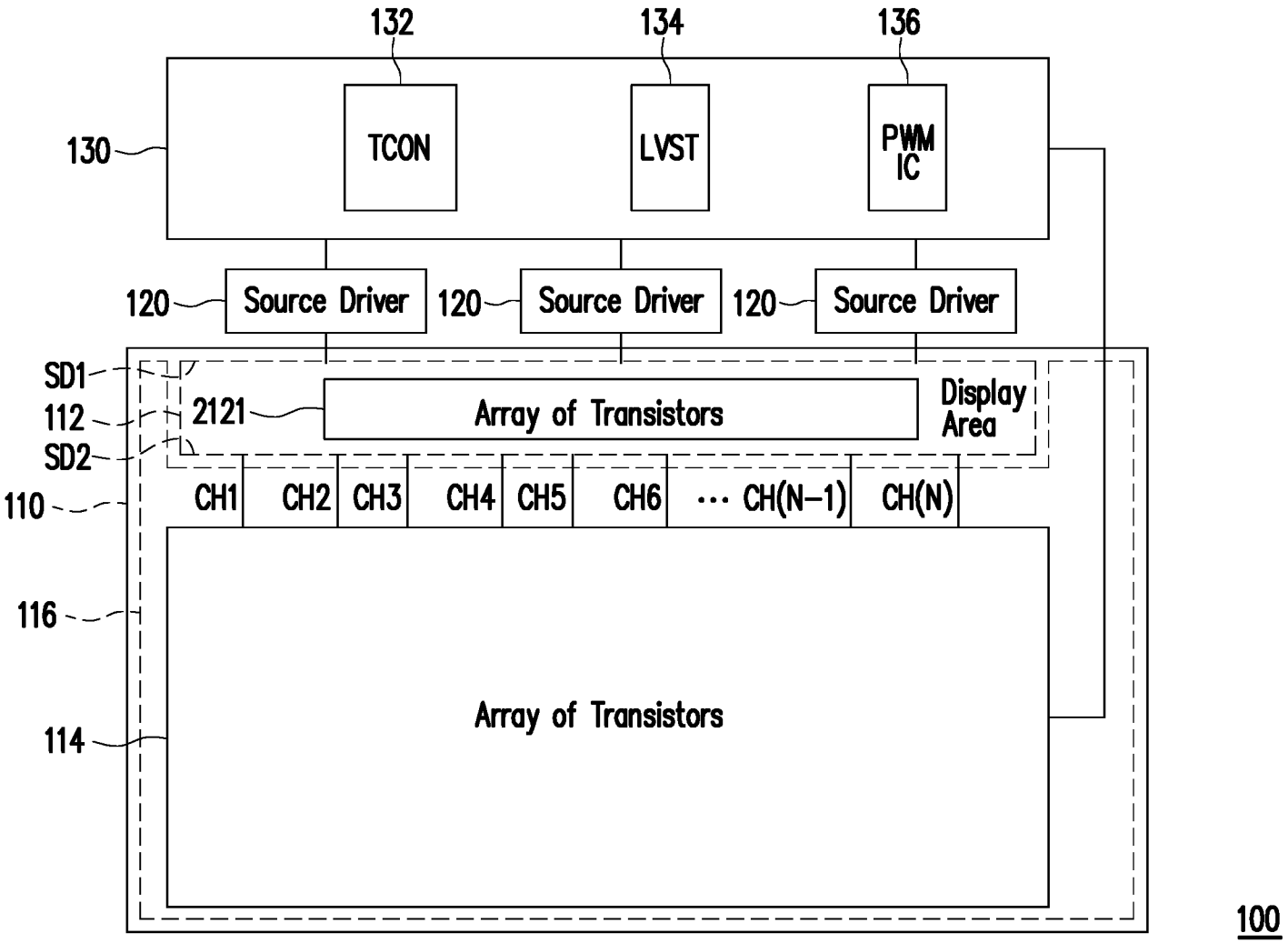
FIG. 1 is a schematic diagram illustrating a display apparatus in accordance with some embodiments.

Referring to FIG. 1, a display apparatus 100 includes a display panel 110, at least one source driver 120 and a control circuit 130. The display panel 110 may include a display area 112 and a non-display area 116 that is different from the display area 112. In some embodiments, the display panel 110 may include a plurality channels CH1 through CH(N) that are divided into a plurality of groups such as two groups, which (preferably but not limitedly) can include a plurality of odd-numbered channels CH1, CH3, CH5 through CH(N−1) and a plurality of even-numbered channels CH2, CH4, CH6 through CH(N). Each of the channels CH1 through CH(N) of the display panel 110 may be coupled to a plurality of pixels (not shown) that are located in the display area 112 for displaying image data. In some embodiments, the display area 112 of the display panel 110 may include an array of transistors 1121 (also referred to as a first array of transistors).

The at least one source driver 120 is coupled to a first side SD1 of the display area 112 of the display panel 110 and is configured to drive the display area 112 of the display panel 110. The at least one source driver 120 may drive the array of transistors 1121 as well as perform a number of different operations on the display panel 110. In some embodiments, the at least one source driver 120 may perform pre-charge operations on the odd-numbered channels CH1, CH3, CH5 through CH(N−1) and the even-numbered channels CH2, CH4, CH6 through CH(N) through the first side SD1 of the display area 112. The at least one source driver 120 may also perform charge-sharing operations on the channels CH1 through CH(N) of the display panel 110 through the first side SD1 of the display area 112. In the same or alternative embodiments, the at least one source driver 120 may perform a charge-sharing operation to share the electric charges of two adjacent channels that include one of the odd-numbered channels and one of the even-numbered channels of the display panel 110. In other embodiments, the at least one source driver 120 may perform a charge-sharing operation to share the electric charges of non-adjacent channels among the channels CH1 through CH(N) of the display panel 110.

In some embodiments, the pre-charge operation and the charge-sharing operation performed by the at least one source driver 120 are controlled by control signals outputted from the control circuit 130. In some embodiments, a pre-charge period of the pre-charge operation performed by the at least one source driver 120 is not overlapped with a charge-sharing period of the charge-sharing operation performed by the at least one source driver 120.

In some embodiments, the non-display area 116 of the display panel 110 may include an array of transistors 114 (also referred to as a second array of transistors) that can be coupled to a second side SD2 of the display area 112 of the display panel 110. The second side SD2 of the display area 112 is opposite to the first side SD1 of the display area 112. The array of transistors 114 is configured to perform a number of different operations such as a pre-charge operation and a charge-sharing operation on the display panel 110 through the second side SD2 of the display area 112.

The array of transistors 114 may perform pre-charge operations on the groups of channels such as the odd-numbered channels CH1, CH3, CH5 through CH(N−1) and the even-numbered channels CH2, CH4, CH6 through CH(N) of the display panel 110 through the second side SD2 of the display area 112. Additionally or alternatively, the array of transistors 114 may perform a charge-sharing operation on the channels CH1 through CH(N) of the display panel 110 during a charge-sharing period that is not overlapped with the pre-charge period of the pre-charge operation performed by the array of transistors 114. In some embodiments, the array of transistors 114 may perform the charge-sharing operation on two adjacent channels to share electric charges between the two adjacent channels, but the disclosure is not limited thereto. The array of transistors 114 may also perform the charge-sharing operation on non-adjacent channels in some other embodiments of the disclosure.

The control circuit 130 may include a timing controller 132. The control circuit 130 may further include a level shifter 134 and pulse-width-modulation (PWM) circuit 136. The control circuit 130 is configured to generate control signals for the at least one of the source driver 120 and the array of transistor 114 to perform the operations (e.g., pre-charge operations and charge-sharing operations) on the display apparatus 100.

Figure 2:
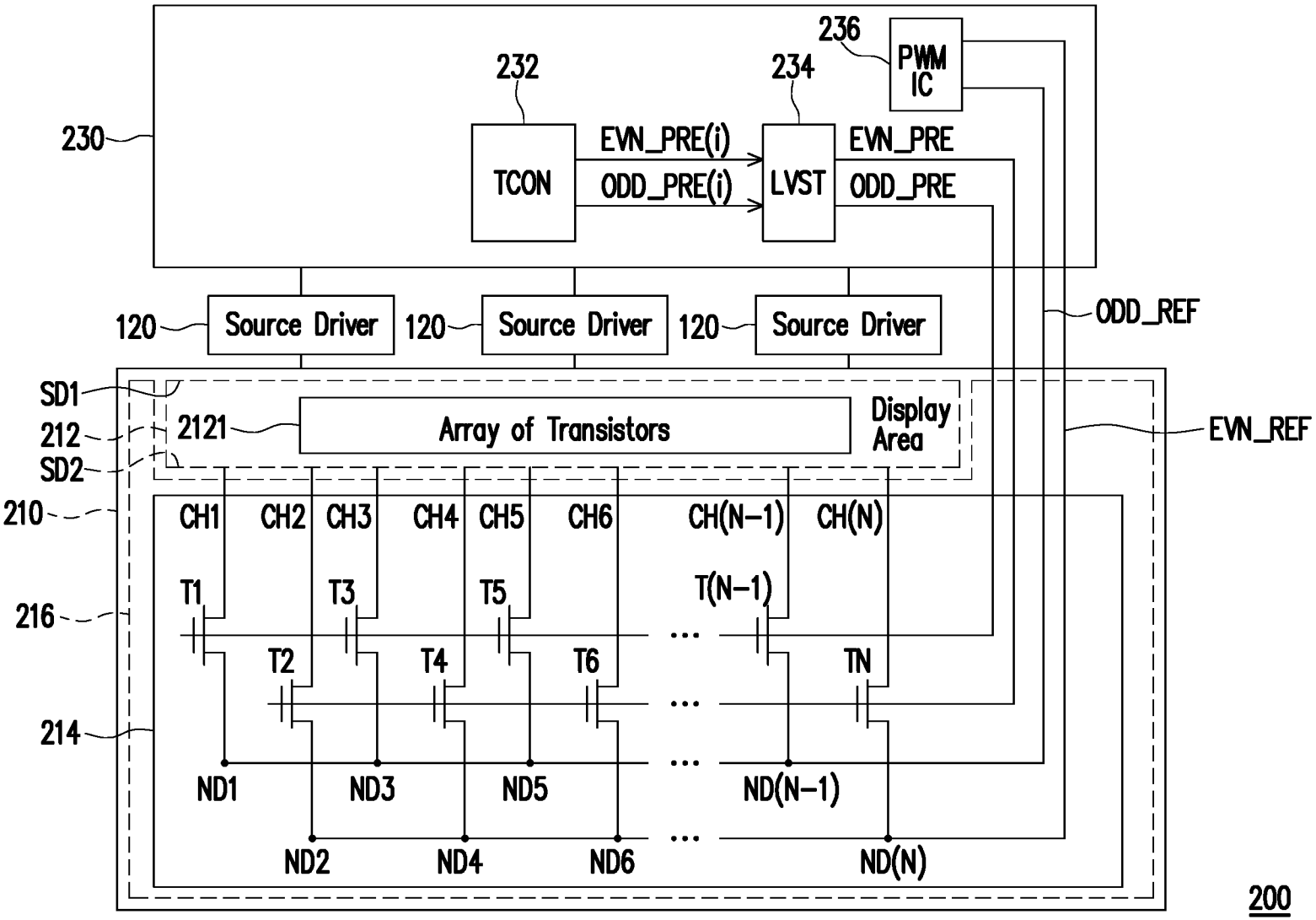
FIG. 2 is a schematic diagram illustrates a detailed structure of a display apparatus in accordance with some embodiments.

Referring to FIG. 2, a display apparatus 200 in accordance with some embodiments is illustrated. The display apparatus 200 may include a display panel 210, at least one source driver 120 and a control circuit 230. The at least one source driver 120 shown in FIG. 2 is similar to the at least one source driver 120 shown in FIG. 1; thus detailed description of the at least one source driver 120 in FIG. 2 is omitted hereafter. The display panel 210 includes a display area 212 and a non-display area 216 that includes an array of transistors 214. The display area 212 may include an array of transistors 2121 that is similar to the array of transistors 1121 as shown in FIG. 1.

The control circuit 230 may include a timing controller 232, a level shifter 234 and a PWM circuit 236. The timing controller 232 and the level shifter 234 are configured to generates a first control signal, e.g., an odd-channel control signal ODD_PRE and a second control signal, e.g., an even-channel control signal EVN_PRE. The first control signal, e.g., the odd-channel control signal ODD_PRE and the second control signal, e.g., the even-channel control signal EVN_PRE may be provided to the array of transistors 214 for controlling pre-charge operations on the first group of channels, e.g., the odd-numbered channels and the second group of channels, e.g., even-numbered channels of the display panel 210, respectively. More specifically, the timing controller 232 may generate a first control signal, e.g., an odd-channel control signal ODD_PRE(i) and a second control signal, e.g., an even-channel control signal EVN_PRE (i), and the level shifter 234 is configured to convert the control signals ODD_PRE(i) and EVN_PRE(i) into the control signals ODD_PRE and EVN_PRE, respectively. In some embodiments, the operating voltage domain of the timing controller 232 is different from the operating voltage domain of the array of transistors 214, and the level shifter 234 is configured to translate levels of the signals ODD_PRE(i) and EVN_PRE(i) to appropriate levels for the array of transistors 214. In some embodiments, the odd-channel control signal ODD_PRE and the even-channel control signal EVN_PRE are used to control the timings of the pre-charge operations performed by the array of transistor 414.

The PWM circuit 236 of the control circuit 230 may generate a first reference voltage, e.g., an odd-channel reference voltage ODD_REF and a second reference voltage, e.g., an even-channel reference voltage EVN_REF. The PWM circuit 236 may also control the levels of the odd-channel reference voltage ODD_REF and an even-channel reference voltage EVN_REF. The generated reference voltages ODD_REF and EVN_REF are provided for the array of transistors 214.

The array of transistors 214 includes a plurality of transistors T1 through TN that are divided into two groups of transistors, such as a plurality of odd-channel transistors T1, T3, T5 through T(N−1) and a plurality of even-channel transistors T2, T4, T6 through TN. Each of the transistors T1 through TN of the array of transistors 214 has a first terminal, a second terminal and a control terminal, in which the first terminal of each of the transistors T1 through TN is coupled to one of the channels CH1 through CH(N), the second terminal is coupled to one of the input terminals ND1 through ND(N), and the control terminal is coupled to the control circuit 230.

The first terminals of the odd-channel transistors T1, T3, T5 through T(N−1) are coupled to (or belong to) the odd-numbered channels CH1, CH3, CH5 through CH(N−1) of the display panel 210, respectively. The second terminals of the odd-channel transistors T1, T3, T5 through T(N−1) are coupled to input terminals ND1, ND3, ND5 through ND(N−1), respectively. The input terminals ND1, ND3, ND5 through ND(N−1) are coupled to the control circuit 230 to receive the odd-channel reference voltage ODD_REF. The control terminals of the odd-channel transistors T1, T3, T5 through T(N−1) are coupled to the control circuit 230 to receive the odd-channel control signal ODD_PRE. Similarly, the first terminals of the even-channel transistors T2, T4, T6 through TN are coupled to (or belong to) the even-numbered channels CH2, CH4, CH6 through CH(N) of the display panel 210, respectively. The second terminals of the even-channel transistors T2, T4, T6 through TN are coupled to input terminals ND2, ND4, ND6 through ND(N), respectively. The input terminals ND2, ND4, ND6 through ND(N) are coupled to the control circuit 230 to receive the even-channel reference voltage EVN_REF. The control terminals of the even-channel transistors T2, T4, T6 through TN are coupled to the control circuit 230 to receive the even-channel control signal EVN_PRE.

In some embodiments, the odd-channel control signal ODD_PRE is used to control the pre-charge operation on the odd-numbered channels CH1, CH3, CH5 through CH(N−1) of the display panel 210. The even-channel control signal EVN_PRE is used to control the pre-charge operation on the even-numbered channels CH2, CH4, CH6 through CH(N) of the display panel 210.

Figure 3:
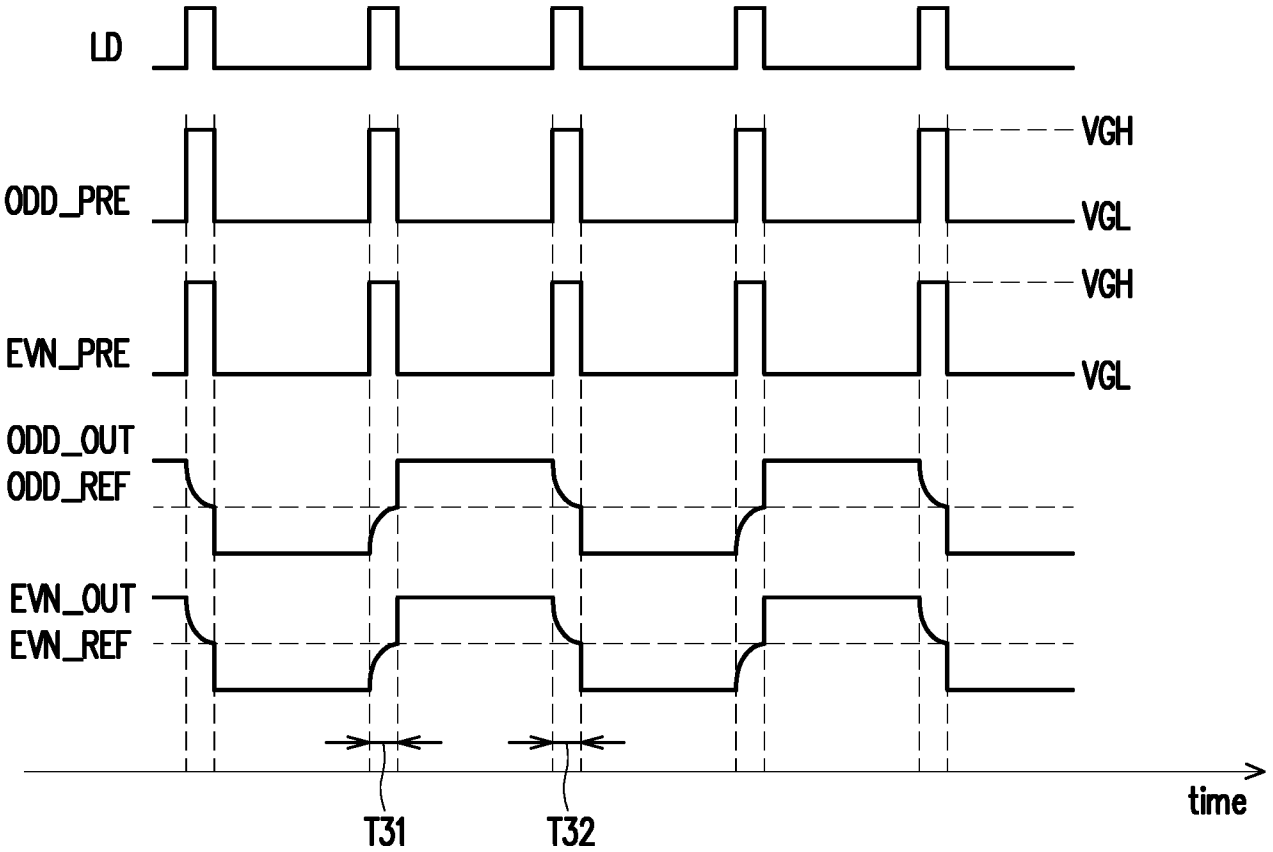
FIG. 3 is a timing diagram illustrating signals in a pre-charge operation in accordance with some embodiments.

Referring to FIG. 2 and FIG. 3, a timing diagram of signals during a pre-charge operation performed by the array of transistors 214 through the second side SD2 of the display area 212 is illustrated. The odd-channel control signal ODD_PRE and the even-channel control signal EVN_PRE are configured to control the pre-charge operations on the odd-numbered channels and even-numbered channels, respectively. The odd-channel control signal ODD_PRE and the even-channel control signal EVN_PRE may be generated according to a load data signal LD. In some embodiments, the odd-channel control signal ODD_PRE and the even-channel control signal EVN_PRE are synchronous with the load data signal LD, but the disclosure is not limited thereto.

In some embodiments, when the odd-channel control signal ODD_PRE is at the high logic state (e.g., VGH), the array of transistors 214 are configured to perform the pre-charge operation on the odd-numbered channels CH1, CH3, CH5 through CH(N−1) of the display panel 210 through the second side SD2 of the display area 212. To perform the pre-charge operation on the odd-numbered channels CH1, CH3, CH5 through CH(N−1), the array of transistors 214 switches on the odd-channel transistors T1, T3, T5 through T(N−1) to shorten the odd-numbered channels CH1, CH3, CH5 through CH(N−1) to the input terminals ND1, ND3, ND5, ND(N−1). Accordingly, the output voltage ODD_OUT of the odd-numbered channels CH1, CH3, CH5 through CH(N−1) are charged to a level of the odd-channel reference voltage ODD_REF. Similarly, when the even-channel control signal EVN_PRE is at the high logic state (e.g., VGH), the array of transistors 214 switches on the even-channel transistors T2, T4, T6 through TN to shorten the even-numbered channels CH2, CH4, CH6 through CH(N) to the input terminals ND2, ND4, ND6, ND(N). Accordingly, the output voltage EVN_OUT of the even-numbered channels CH2, CH4, CH6 through CH(N) are charged to a level of the even-channel reference voltage EVN_REF.

In some embodiments, during the pre-charge period of the pre-charge operation performed by the array of transistor 214, the at least one source drive 120 stops loading data to the odd-numbered channels CH1, CH3, CH5 through CH(N−1) and the even-numbered channels CH2, CH4, CH6 through CH(N) of the display area 212.

In some embodiments, the pre-charge period of the pre-charge operation on the odd-numbered channels of the display panel 210 overlaps the pre-charge period of the pre-charge operation on the even-numbered channels of the display panels. As shown in FIG. 3, during a pre-charge period T31, the array of the transistor 214 performs a pre-charge operation on the odd-numbered channels and the even-numbered channels for a first polarity of the display panel 210. During a pre-charge period T32, the array of the transistor 214 performs a pre-charge operation on the odd-numbered channels and the even-numbered channels for a second polarity of the display panel 210. The first polarity is different from the second polarity of the display panel 210.

In some embodiments, the at least one source driver 120 is configured to perform a pre-charge operation to the odd-numbered channels and even-numbered channels of the display panel through the first side SD1 of the display area 212. In addition, the array of transistors 214 performs pre-charge operations on the odd-numbered channels and the even-numbered channels through the second side SD2 in a pre-charge period which is overlapped with a pre-charge period during which the at least one source driver 120 performs the pre-charging operations on the odd-number channels and the even-numbered channels through the first side SD1 of the display area 212.

Figure 4:
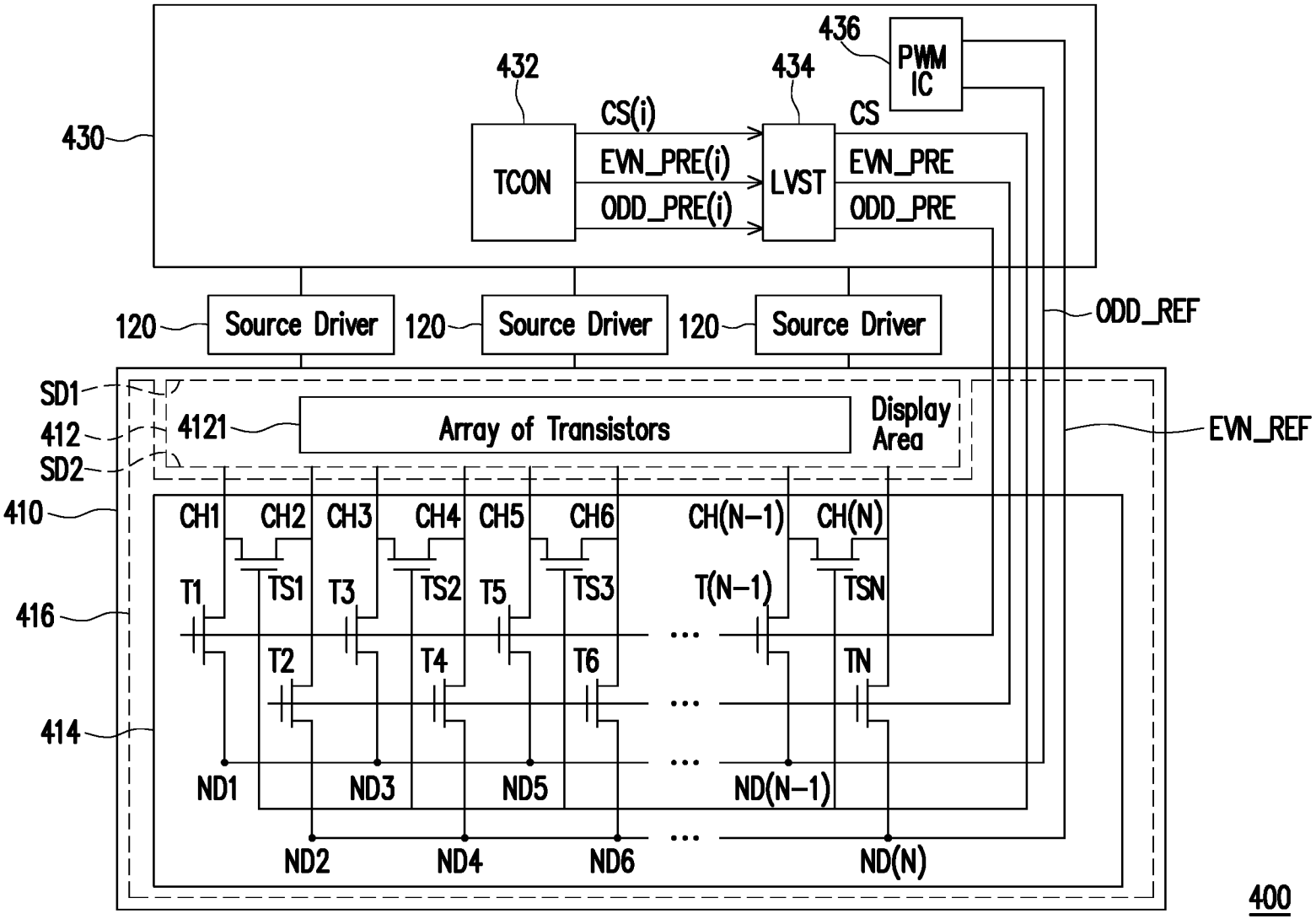
FIG. 4 is a schematic diagram illustrating a display apparatus in accordance with some embodiments.

Referring to FIG. 4, a schematic diagram of a display apparatus 400 in accordance with some embodiments is illustrated. The display apparatus 400 may include a display panel 410, at least one source driver 120 and a control circuit 430. The at least one source driver 120 shown in FIG. 4 is similar to the at least one source driver 120 shown in FIG. 1 and FIG. 2, thus detailed description of the at least one source driver 120 is omitted hereafter. The display panel 410 includes a display area 412 and a non-display area 416 that includes an array of transistors 414. The display area 412 may include an array of transistors 4121 that is similar to the array of transistors 1121 as shown in FIG. 1 and the array of transistor 2121 as shown in FIG. 2.

One of the differences between the display apparatus 400 shown in FIG. 4 and the display apparatus 200 shown in FIG. 2 is that the array of transistors 414 further includes a plurality of charge-sharing transistors TS1, TS2, TS3 through TSN. Each of the charge-sharing transistors TS1, TS2, TS3 through TSN is coupled between one of the odd-channel transistors T1, T3, T5 through T(N−1) and one of the even-channel transistors T2, T4, T6 through TN. In addition, a control terminal of each of the charge-sharing transistors TS1, TS2, TS3 through TSN is coupled to the control circuit 430 to receive a charge-sharing control signal CS. In some embodiments, each of the charge-sharing transistors TS1, TS2, TS3 through TSN is coupled between two adjacent channels among the channels CH1 through CH(N), and is configured to share electric charges between the two adjacent channels. For example, the charge-sharing transistor TS1 is coupled between the odd-numbered channel CH1 and the even-numbered channel CH2, and is configured to share electric charges between the odd-numbered channel CH1 and the even-numbered channel CH2. However, the disclosure is not limited thereto, and each of the charge-sharing transistors TS1, TS2, TS3 through TSN may be configured to share electric charges among multiple non-adjacent channels among the channels CH1 through CH(N) of the display panel 410.

Another one of the differences between the display apparatus 400 shown in FIG. 4 and the display apparatus 200 shown in FIG. 2 is that a timing controller 432 and a level shifter 434 of the control circuit 430 may further generate the charge-sharing control signal CS in addition to the odd-channel control signal ODD_PRE and the even-channel control signal EVN_PRE. The charge-sharing control signal CS is provided to the control terminal of each of the charge-sharing transistors TS1, TS2, TS3 through TSN of the array of the transistors 414.

Figure 5:
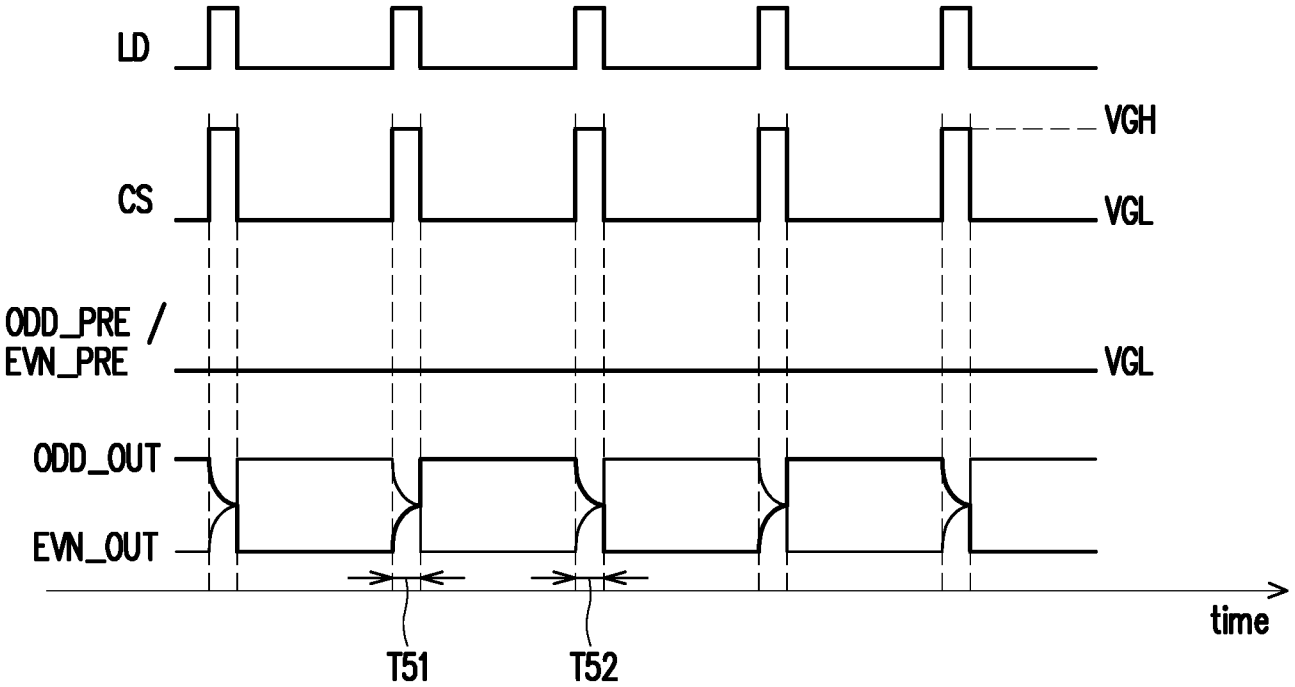
FIG. 5 is a timing diagram illustrating signals in a charge-sharing operation in accordance with some embodiments.

Referring to FIG. 4 and FIG. 5, a timing diagram of signals in a charge-sharing operation performed by the array of transistors 414 through the second side SD2 of the display area 412 is illustrated. During the charge-sharing operation, the odd-channel control signal ODD_PRE and the even-channel control signal EVN_PRE are at the low logic state (e.g., VGL). As such, the pre-charge period of the pre-charge operation does not overlap the charge-sharing period of the charge-sharing operation. The charge-sharing control signal CS which is configured to control the charge-sharing operation may be generated according to the load data signal LD. In some embodiments, the charge-sharing control signal CS is synchronous with the load data signal LD, but the disclosure is not limited thereto. In some embodiments, during the charge-sharing period of the charge-sharing operation performed by the array of transistor 214, the at least one source drive 120 stops loading data to the odd-numbered channels CH1, CH3, CH5 through CH(N−1) and the even-numbered channels CH2, CH4, CH6 through CH(N) of the display area 212.

As shown in FIG. 5, the period T51 is a charge-sharing period for the first polarity of the display panel 410 and the period T52 is a charge-sharing period for the second polarity of the display panel 410, wherein the first polarity is different from the second polarity. During the charge-sharing period T51, the charge-sharing control signal CS is configured to switch on the charge-sharing transistors TS1 through TSN. As a result, electric charges of the channels that are coupled to each of the charge-sharing transistors TS1 through TSN are shared to each other. As an example, the electric charges of the odd-numbered channel CH1 and the even-numbered channel CH2 are shared to each other through the charge-sharing transistor TS1. As a result of the charge-sharing operation, the output voltage ODD_OUT is equal to the output voltage EVN_OUT at the end of the charge-sharing period T51 and T52.

In some embodiments, the source driver 120 of the display apparatus 400 may perform a charge-sharing operation to the channels of the display panel 410 through the first side SD1 of the display area 412. The charge-sharing performed by the source driver 120 through the first side SD1 of the display area 412 is different from the charge-sharing performed by the array of transistor 414 through the second side SD2 of the display area 412. In some embodiments, the charge-sharing period of the charge-sharing operation performed by the source driver 120 may wholly or partially overlap the charge-sharing period of the charge-sharing operation performed by the array of transistor 414. In this way, the charge-sharing operations are performed on the channels of the display panel 410 through both sides (first side SD1 and second side SD2) of the display area 412. As such, the performance of the charge-sharing operation can be improved while overall power consumption for the charge-sharing operation can be reduced.

Figure 6:
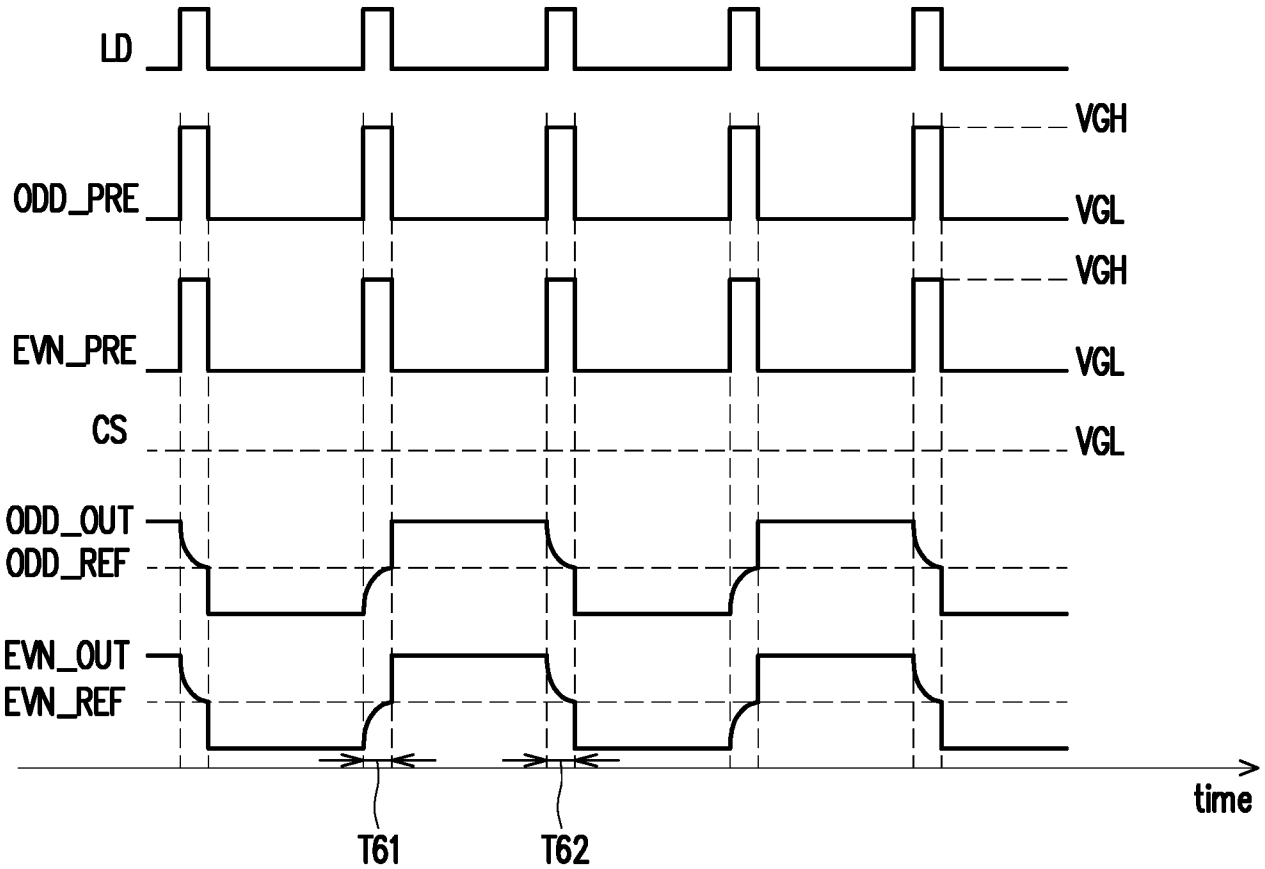
FIG. 6 is a timing diagram illustrating signals in a pre-charge operation in accordance with some embodiments.

Referring to FIG. 4 and FIG. 6, a timing diagram of signals during a pre-charge operation performed by the array of transistors 414 through the second side SD2 of the display area 412 is illustrated. During the pre-charge operation shown in FIG. 6, the charge-sharing control signal CS is at the low logic state to disable the charge-sharing operation. In other words, the charge-sharing operation would not be performed during the pre-charge operation.

In some embodiments, the odd-channel control signal ODD_PRE and the even-channel control signal EVN_PRE are synchronous with the load data signal LD. When the odd-channel control signal ODD_PRE is at the high logic state, the array of transistors 414 switches on the odd-channel transistors T1, T3, T5 through T(N−1) to shorten the odd-numbered channels CH1, CH3, CH5 through CH(N−1) to the input terminals ND1, ND3, ND5, ND(N−1). Accordingly, the output voltage ODD_OUT of the odd-numbered channels CH1, CH3, CH5 through CH(N−1) are charged to a level of the odd-channel reference voltage ODD_REF. Similarly, when the even-channel control signal EVN_PRE is at the high logic state, the array of transistors 414 switches on the even-channel transistors T2, T4, T6 through TN to shorten the even-numbered channels CH2, CH4, CH6 through CH(N) to the input terminals ND2, ND4, ND6, ND(N). Accordingly, the output voltage EVN_OUT of the even-numbered channels CH2, CH4, CH6 through CH(N) are charged to a level of the even-channel reference voltage EVN_REF.

As shown in FIG. 6, the period T61 is a pre-charge period for the first polarity of the display panel 410 and the period T62 is a pre-charge period for the second polarity of the display panel 410, wherein the first polarity is different from the second polarity. During the pre-charge periods T61 and T62, the odd-channel control signal ODD_PRE and the even-channel control signal EVN_PRE are at the high logic state. As a result, the array of transistors 414 performs the pre-charge operations on the odd-numbered channels CH1, CH3, CH5 through CH(N−1) and the even-numbered channels CH2, CH4, CH6 through CH(N).

In some embodiments, the source driver 120 of the display apparatus 400 may perform a pre-charge operation to the odd-numbered channels and even-numbered channels through the first side SD1 of the display area 412. The pre-charge operation performed by the source driver 120 through the first side SD1 of the display area 412 is different from the pre-charge operation performed by the array of transistor 414 through the second side SD2 of the display area 412. In some embodiments, the pre-charge period of the pre-charge operation performed by the source driver 120 may be wholly or partially overlap the pre-charge period of the pre-charge operation performed by the array of transistor 414. In this way, the odd-numbered channels and the even-numbered channels of the display panel 410 may be pre-charged through both sides (first side SD1 and second side SD2), in other words, more efficiently. As such, the performance of the pre-charge operation can be improved while overall power consumption for the pre-charge operation can be reduced.

Figure 7:
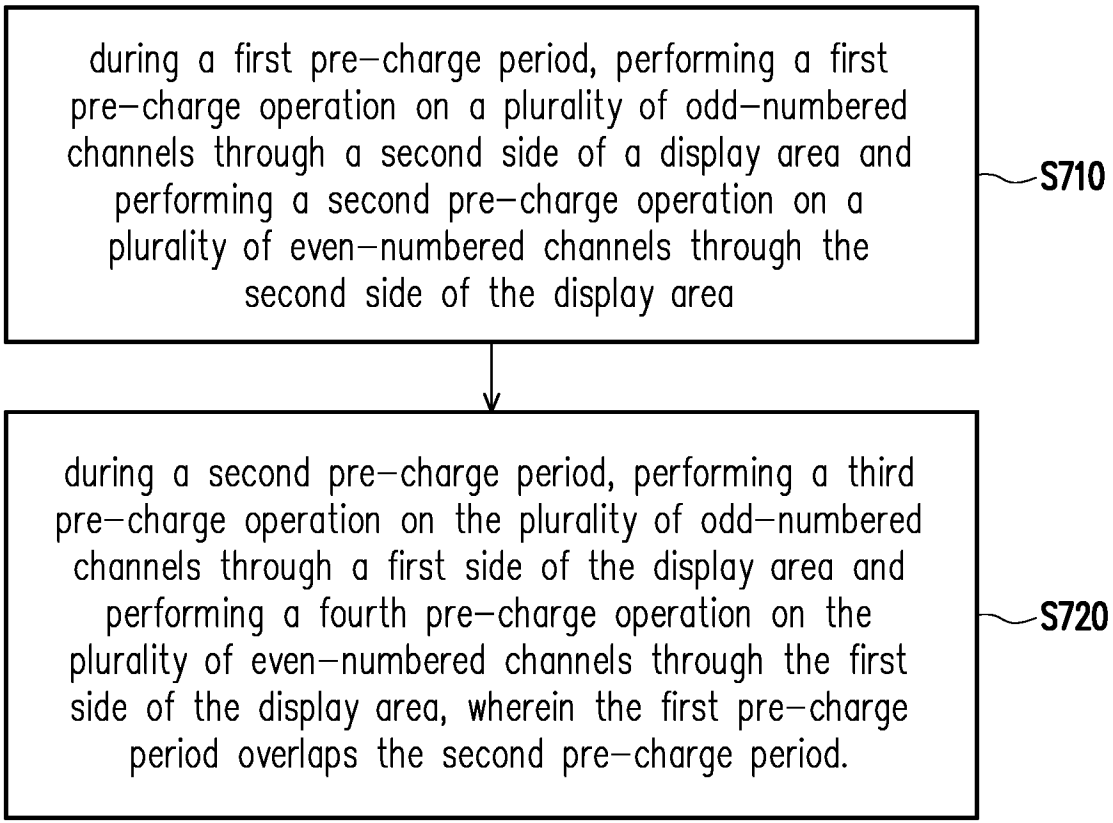
FIG. 7 is a flowchart diagram illustrating a method for pre-charging channels of a display panel in accordance with some embodiments.

Referring to FIG. 7, a method of a pre-charge operation in accordance with some embodiments is illustrated. In step S710, during a first pre-charge period, a first pre-charge operation is performed on a plurality of odd-numbered channels through a second side of a display area, and a second pre-charge operation is performed on the even-numbered channels through the second side of the display area.

In step S720, during a second pre-charge period, a third pre-charge operation is performed on the odd-numbered channels through a first side of the display area, and a fourth pre-charge operation is performed on the even-numbered channels through the first side of the display area. The first pre-charge period may be wholly or partially overlapped with the second pre-charge period.

From the above embodiments, at least one source driver is coupled to a first side of a display area of a display panel and an array of the transistors are coupled to a second side of the display area of the display panel. The array of transistor may perform a first and second pre-charge operations to odd-numbered channels and even-numbered channels, respectively through the second side of the display area. The source driver may perform a third and fourth pre-charge operations to the odd-numbered channels and the even-numbered channels, respectively through the first side of the display area. In this way, the pre-charge operations are performed through both sides of the display area of the display panel. As a result, the performance of the pre-charge operations on the odd-numbered channels and even-numbered channels of the display panel is improved. In addition, the pre-charge time for the pre-charge operations may be shorter and the overall power consumption for the pre-charge operations can be reduced.

In the same or alternative embodiments, the array of transistors may further perform a first charge-sharing operation on the channels of the display panel through the first side of the display area, and the at least one source driver may perform a second charge-sharing operation on the channels of the display panel through the second side of the display area. In this way, the efficiency of the charge-sharing operations on the channels of the display panel is improved.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A display apparatus, comprising:

a display panel, comprising a display area comprising a first array of transistors and a non-display area comprising a second array of transistors, wherein the display panel has a plurality of channels divided into a plurality of odd-numbered channels and a plurality of even-numbered channels;

at least one source driver, coupled to a first side of the display area of the display panel and configured to drive the first array of transistors; and at least one control circuit, configured to generate at least one control signal for controlling the second array of transistors to perform the first pre-charge operation and the second pre-charge operation;

wherein the second array of transistors is coupled to a second side of the display area of the display panel and is configured to perform a first pre-charge operation on the plurality of odd-number channels and perform a second pre-charge operation on the plurality of even-numbered channels through the second side of the display area, wherein the first side is opposite to the second side, wherein the control signal comprises an odd-channel control signal and an even-channel control signal respectively to control a first timing of the first pre-charge operation and a second timing of the second pre-charge operation, wherein the control circuit comprises: a timing controller, configured to generate the odd-channel control signal and the even-channel control signal, and configured to control an operation of the at least one source driver.

2. The display apparatus of claim 1, wherein the second array of transistors performs the first pre-charge operation and the second pre-charge operation during a first pre-charge period which is overlapped with a second pre-charge period during which the at least one source driver is configured to perform a third pre-charge operation on the plurality of odd-number channels and perform a fourth pre-charge operation on the plurality of even-numbered channels through the first side of the display area.

3. The display apparatus of claim 1, wherein the second array of transistors comprising:

a plurality of odd-channel transistors, coupled between the plurality of odd-numbered channels of the display area and a first input terminal that receives an odd-channel reference voltage; and a plurality of even-channel transistors, coupled between the plurality of even-numbered channels of the display area and a second input terminal that receives an even-channel reference voltage.

4. The display apparatus of claim 3, wherein each of the plurality of odd-channel transistors comprises a control terminal configured to receive the odd-channel control signal, and each of the plurality of even-channel transistors comprises a control terminal configured to receive the even-channel control signal.

5. The display apparatus of claim 4, wherein the plurality of odd-channel transistors are turned on during a first pre-charge period according to the odd-channel control signal to transmit a level of the odd-channel reference voltage to the plurality of odd-numbered channels of display area through the second side of the display area, and the plurality of even-channel transistors are turned on during a second pre-charge period according to the even-channel control signal to transmit a level of the even-channel reference voltage to the plurality of even-numbered channels of display area through the second side of the display area.

6. The display apparatus of claim 1, wherein the control signal comprises the odd-channel reference voltage and the even-channel reference voltage respectively to control a first pre-charge-level of the first pre-charge operation and a second pre-charge-level of the second pre-charge operation.

7. The display apparatus of claim 6, wherein the control circuit comprises a pulse-width-modulation circuit, configured to generate the odd-channel reference voltage and the even-channel reference voltage.

8. The display apparatus of claim 1, wherein the second array of transistors is further configured to perform a first charge-sharing operation between a plurality of the channels through the second side of the display area.

9. The display apparatus of claim 8, wherein the second array of transistors is further configured to perform the first charge-sharing operation between a plurality of adjacent channels of the plurality of channels through the second side of the display area.

10. The display apparatus of claim 8, wherein the second array of transistors is configured to perform the first pre-charge operation and the second pre-charge operation during a pre-charge period and the second array of transistors is configured to perform the first charge-sharing operation during a charge-sharing period not overlapped with the pre-charge period.

11. The display apparatus of claim 8, wherein the second array of transistors perform the first charge-sharing operation between the plurality of the channels through the second side of the display area during a first charge-sharing period which is overlapped with a second charge-sharing period during which the at least one source driver is configured to perform a second charge-sharing operation between the plurality of channels through the first side.

12. The display apparatus of claim 9, wherein the second array of transistors comprises:

a plurality of odd-channel transistors, coupled between the plurality of odd-numbered channels of the display area and a first input terminal that receives an odd-channel reference voltage;

a plurality of even-channel transistors, coupled between the plurality of even-numbered channels of the display area and a second input terminal that receives an even-channel reference voltage; and a plurality of charge-sharing transistors, wherein each of the plurality of charge-sharing transistors is coupled between one of the plurality of odd-numbered channels of the display area and one of the plurality of even-numbered channels of the display area, and a control terminal of each of the plurality of charge-sharing transistors receives a charge-sharing control signal.

13. The display apparatus of claim 12, wherein the plurality of charge-sharing transistors are turned on during a charge-sharing period to share electric charges between the plurality of odd-numbered channels of the display area and the plurality of even-numbered channels of the display area.

14. The display apparatus of claim 13, wherein the plurality of odd-channel transistors and the plurality of even-channel transistors are turned off during the charge-sharing period, and during a pre-charge period, the plurality of charge-sharing transistors are turned off and the plurality of odd-channel transistors and the plurality of even-channel transistors are turned on.

15. The display apparatus of claim 1, wherein the first pre-charge operation and the second pre-charge operation occur in a period in which the at least one source drive stops loading data to the plurality of odd-numbered channels and the plurality of even-numbered channels of the display area.

16. The display apparatus of claim 8, wherein the first charge-sharing operation occurs in a period in which the at least one source drive stops loading data to the plurality of odd-numbered channels and the plurality of even-numbered channels of the display area.

17. A method, adapted to a display apparatus comprising a display panel having a display area and a plurality of channels divided into a plurality of odd-numbered channels and a plurality of even-numbered channels, the display area comprising a first side and a second side, the method comprising:

during a first pre-charge period, performing a first pre-charge operation on the plurality of odd-numbered channels through the second side of the display area and performing a second pre-charge operation on the plurality of even-numbered channels through the second side of the display area;

during a second pre-charge period, performing a third pre-charge operation on the plurality of odd-numbered channels through the first side of the display area and performing a fourth pre-charge operation on the plurality of even-numbered channels through the first side of the display area, wherein the first pre-charge operation and the second pre-charge operation are performed by a second array of transistors which is coupled to the second side of the display area, wherein the first side is opposite to the second side; and generating at least one control signal for controlling the second array of transistors to perform the first pre-charge operation and the second pre-charge operation, wherein the control signal comprises an odd-channel control signal and an even-channel control signal respectively to control a first timing of the first pre-charge operation and a second timing of the second pre-charge operation, wherein the first pre-charge period overlaps the second pre-charge period, and the step of generating at least one control signal for controlling the second array of transistors to perform the first pre-charge operation and the second pre-charge operation comprises generating the odd-channel control signal and the even-channel control signal.

18. The method of claim 17, wherein the third pre-charge operation and the fourth pre-charge operation are performed by at least one source driver which is coupled to the first side of the display area.

19. The method of claim 18, wherein the second array of transistors comprises a plurality of odd-channel transistors and a plurality of even-channel transistors, and the step of performing the first pre-charge operation and the second pre-charge operation comprises:

providing an odd-channel reference voltage and an even-channel reference voltage, turning on the plurality of odd-channel transistors during the first pre-charge period according to the odd-channel control signal to transmit a level of an odd-channel reference voltage to the plurality of odd-numbered channels of display area through the second side of the display area; and turning on the plurality of even-channel transistors during the first pre-charge period according to the even-channel control signal to transmit a level of the even-channel reference voltage to the plurality of even-numbered channels of display area through the second side of the display area.

20. The method of claim 19, further comprising:

performing, by the second array of transistors, a first charge-sharing operation between the plurality of the channels through the second side of the display area during a first charge-sharing period; and performing, by the at least one of source driver, a second charge-sharing operation between the plurality of the channels through the first side of the display area during a second charge-sharing period, wherein the first charge-sharing period overlaps the second charge-sharing period, and the first charging-sharing period and the second charge-sharing period does not overlap the first pre-charge period and the second pre-charge period.

21. The method of claim 20, wherein performing, by the second array of transistors, the first charge-sharing operation comprises:

turning off the plurality of odd-channel transistors during the first charge-sharing period according to the odd-channel control signal, wherein the plurality of odd-channel transistors are coupled to the plurality of odd-numbered channels of the display area;

turning off the plurality of even-channel transistors during the first charge-sharing period according to the even-channel control signal, wherein the plurality of even-channel transistors are coupled to plurality of even-numbered channels of the display area; and turning on the plurality of charge-sharing transistors during the charge-sharing period according to the charge-sharing control signal to share electric charges between the plurality of odd-numbered channels and the plurality of even-numbered channels of the display area.

22. The method of claim 21, wherein each of the plurality of charge-sharing transistors is coupled between one of the plurality of odd-channel transistors and one of the plurality of even-channel transistors, and the odd-channel control signal, the even-channel control signal and the charge-sharing control signal are generated by a timing controller of the display apparatus.

* * * * *